United States Patent [19]

Abitbol

[11] 3,988,793

[45] Nov. 2, 1976

[54] DEVICE FOR PREVENTING AND TREATING TOXEMIA IN PREGNANT WOMEN

[76] Inventor: M. Maurice Abitbol, 41 Allenwood Road, Great Neck, N.Y. 11023

[22] Filed: Sept. 16, 1975

[21] Appl. No.: 613,812

[52] U.S. Cl. ..... 5/365; 128/361

[51] Int. Cl.[2] ..... A47C 27/08

[58] Field of Search ..... 128/1 R, 28, 31, 297–301, 128/361; 5/348, 90, 91, 365; 138/361, 1 R

[56] References Cited

UNITED STATES PATENTS

| | | | |
|---|---|---|---|
| 1,548,728 | 8/1925 | Milam | 5/91 |
| 2,537,906 | 1/1951 | Over | 5/91 |
| 3,062,215 | 11/1962 | Heyns | 128/361 |
| 3,118,152 | 1/1964 | Talley | 5/338 |
| 3,287,747 | 11/1966 | Ellsworth | 5/338 |

*Primary Examiner*—Paul R. Gilliam
*Assistant Examiner*—Andrew M. Calvert

[57] ABSTRACT

A mattress device designed for treating a pregnant woman by releasing the pressure ordinarily produced by the pregnant uterus and the abdominal wall on the abdominal aorta, thereby helping to prevent complications of pregnancy, such as toxemia and fetal distress. The device comprises a thick mattress-like member having an inflated ring extending through the mattress with a chamber formed on the central portion of the ring. The chamber is open at the top for receiving the pregnant uterus of a woman lying in the prone position, with her abdominal wall floating freely in the chamber. The inflated ring is filled to an air pressure which provides a body support that compensates for the heavier weight around the midsection. The combination of the variable air pressure of the ring and different sizes and shapes of such ring permit a mattress support well adapted to the varied sizes and shapes of the pregnant uterus while also enabling the abdominal wall to float freely in the chamber. The bottom of the chamber is closed by a wall in air-tight relation with the side walls of the ring. The top, outside surface of the ring is made of a rubber-like or plastic material that can form an air-tight seal with the skin of the woman around the area adjacent the pregnant uterus. In this fashion, an enclosed chamber is formed which is connected in fluid communication with a vacuum pump. The negative pressure in the chamber further relieves the pressure of the pregnant uterus and the abdominal wall on the abdominal aorta.

12 Claims, 5 Drawing Figures

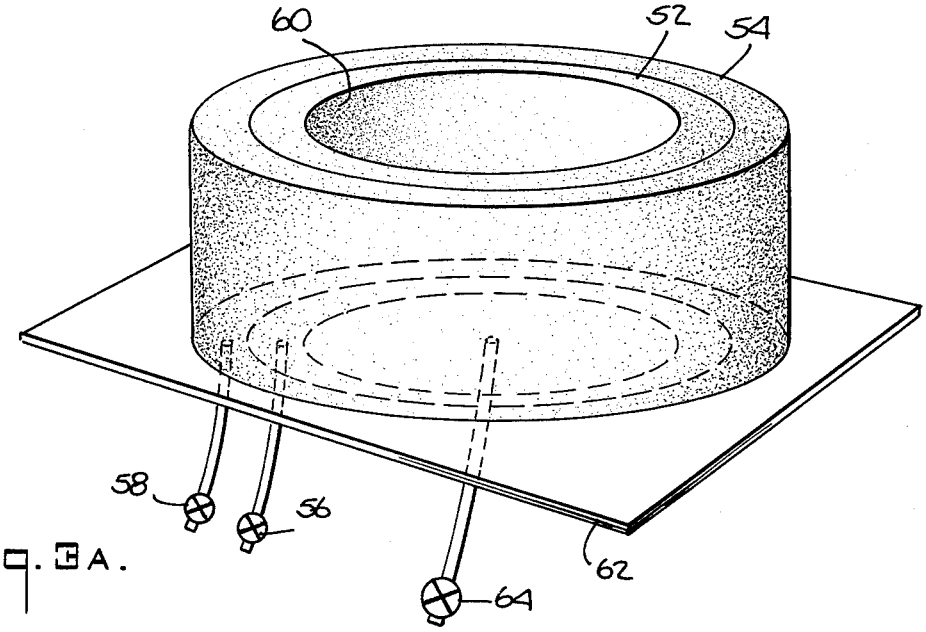
Fig. 3A.
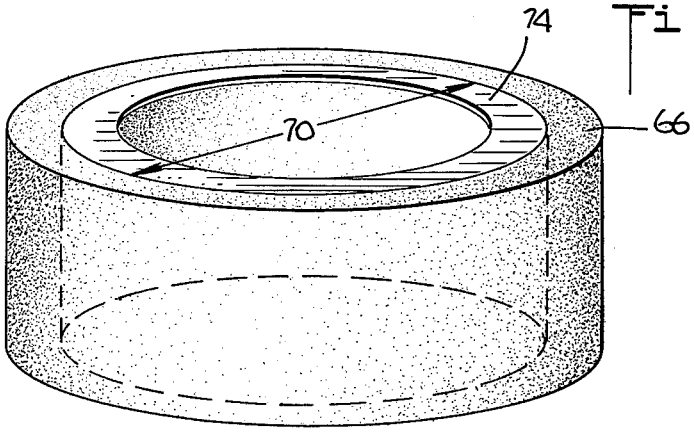
Fig. 3B.
Fig. 3C.
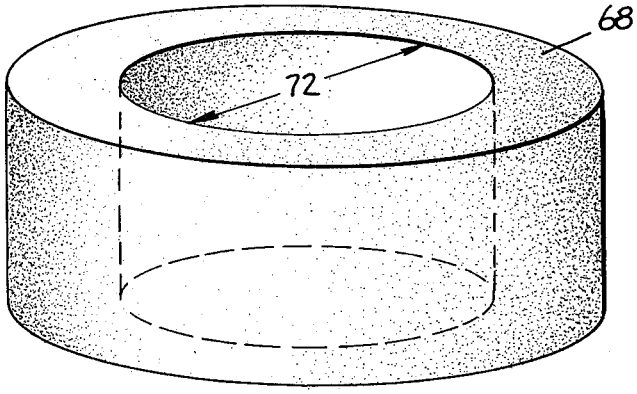

DEVICE FOR PREVENTING AND TREATING TOXEMIA IN PREGNANT WOMEN

BACKGROUND OF THE INVENTION

The present invention relates to the treatment of pregnant women and more particularly to a mattress device for treating a pregnant woman lying in the ventral position.

In the past, there have been proposed mattresses having a cavity located in the central portion and adapted to accommodate the enlarged abdomen of an expectant mother sleeping or resting in a face-down position. In U.S. Pat. No. 3,378,862 issued on Apr. 23, 1968 to J. P. Skinner, there is disclosed a foam rubber mattress having a cavity shaped to accommodate the expanded abdomen of a woman in full term pregnancy, with a stretchable panel covering the top of the cavity so as to support the expanded abdomen. The panel thereby is designed to serve as a continuing support for the expanded abdomen during the progressive stages of pregnancy since it provides a resistance or tension on the abdominal wall. In U.S. Pat. No. 3,118,152 issued on Jan. 21, 1964 to R. B. Talley, Jr., there is disclosed a maternity mattress pad made up of sections around a central opening. Also, in U.S. Pat. No. 3,287,747 issued on Nov. 29, 1966 to Ellsworth, there is disclosed a maternity mattress abdominal cushion having an elliptical shape in plan contour.

Generally, the known attempts to place pregnant women in the ventral or prone position were intended primarily for comfort reasons and to satisfy the habit of those patients that sleep on their stomachs. The prior art mattress devices have cavities or depressions for accommodating the pregnant uterus, but only in a minimal degree or in no manner do such mattresses relieve the pressure caused by the pregnant uterus or by the abdominal wall on the abdominal aorta. Such mattresses or cushions generally produce a pressure on the abdominal wall through the bottom or sides of the cavity walls or the cushion.

Conventional mattresses are designed with substantially equal distribution of spring or padding support throughout the mattress. For the pregnant woman sleeping or resting in the prone position the expanded abdomen, in addition to its enlarged size, presents a concentration of body weight in one area of the mattress. Therefore, it is also desirable to provide a mattress for the pregnant woman which not only supports the pregnant woman lying in the prone or ventral position with her abdominal wall floating freely, but also adequately supports the entire body especially in the heavier region around the midsection. By supporting the patient in the ventral position with the abdominal wall floating freely, the uterus will be pressing on the abdominal wall rather than on the abdominal aorta. This eliminates possible consequences of pressure on the abdominal aorta, namely, the interference with the blood supply to the lower half of the body including the pregnant uterus, leading to serious complications such as fetal distress and toxemia.

Also, vacuum devices have been employed for treating pregnant women, such as the rigid cylindrical drum fitted around the midsection with a sack and extension enclosing the legs and feet, as disclosed in U.S. Pat. No. 3,642,006 issued on Feb. 15, 1972 to W. Wobbe. There, the woman stands in the sack and, the partial vacuum causes a strengthening of the blood penetration in the abdominal region. In U.S. Pat. No. 3,062,215 issued on Nov. 6, 1962 to O. S. Heyns, there is disclosed a suction dome applied to the abdomen and a flexible suit receiving suction while the patient is in the dorsal, sitting or standing position, to thereby stimulate labor by distending the abdominal wall outwardly, while the part of the suit around the legs collapses to maintain the legs at substantially atmospheric pressure.

The known vacuum devices are designed primarily for use while the patient is in the dorsal, sitting or standing position. While such devices provide relief to abdominal wall tension, they do not relieve the pressure of the pregnant uterus on the abdominal aorta since the suction pulls on the wall rather than on the uterus. Furthermore, such devices are bulky and cumbersome and therefore can be used for only a few hours without serious discomfort. Also, it is apparent that a patient could not sleep through the night with such equipment.

SUMMARY OF THE INVENTION

It is an object of the present invention to provide a device for treating a pregnant woman while sleeping or resting in the ventral position. It is another object to provide a special mattress device which relieves the pressure ordinarily produced by the pregnant uterus and the abdominal wall on the abdominal aorta. It is another object to provide a mattress device which supports the pregnant uterus in the free float condition, without the pressure of the mattress or other bedding against the abdominal wall. It is a further object to provide a device for treating a pregnant woman which is not cumbersome and bulky for the user.

These and other objects are achieved by the present invention which provides a mattress device designed for treating a pregnant woman by releasing the pressure ordinarily produced by the pregnant uterus and the abdominal wall on the abdominal aorta, thereby helping to prevent complications of pregnancy, such as toxemia and fetal distress. The device comprises a thick mattress-like member having near its central portion an inflated ring extending through the mattress with a chamber formed in the center of the ring. The chamber is open at the top for receiving the pregnant uterus of a woman lying face down in the prone position, with her abdominal wall floating freely in the chamber. The inflated ring is filled to an air pressure which provides a body support that compensates for the heavier weight around the midsection. The combination of the variable air pressure and different available sizes and shapes of such ring permit a mattress support well adapted to the varied sizes and shapes of the pregnant uterus while also enabling the abdominal wall to float freely in the chamber. The bottom of the chamber is closed by a wall in air-tight relation with the side walls of the ring. The top, outside surface of the ring is made of or attached to rubber-like or plastic material that can form an air-tight seal with the skin of the woman around the area adjacent the abdominal region. In this fashion, an enclosed chamber is formed which is connected in fluid communication with a vacuum pump. The negative pressure in the chamber further relieves the pressure of the pregnant uterus and the abdominal wall on the abdominal aorta.

The mattress device of the present invention fully avoids any pressure against the abdominal wall by the mattress, box spring or cushion devices, by its use of both the added support for the body as provided by the inflated ring within the mattress, and the deep chamber which encircles the pregnant uterus and permits it to float freely while the woman sleeps or rests in the ventral position. This, in turn, relieves the pressure of the pregnant uterus on the abdominal aorta. Also, the vacuum device in the mattress chamber is not cumbersome for the woman and permits her to sleep comfortably on the mattress while the vacuum device is in operation.

BRIEF DESCRIPTION OF THE DRAWINGS

FIG. 3A shows one embodiment of the ring support member comprising two concentric rings; FIG. 3B shows another embodiment of the ring support member comprising a large inner diameter; and FIG. 3C shows another embodiment of the ring support member comprising a relatively small inner diameter.

DESCRIPTION OF THE PREFERRED EMBODIMENTS

Figure 1:
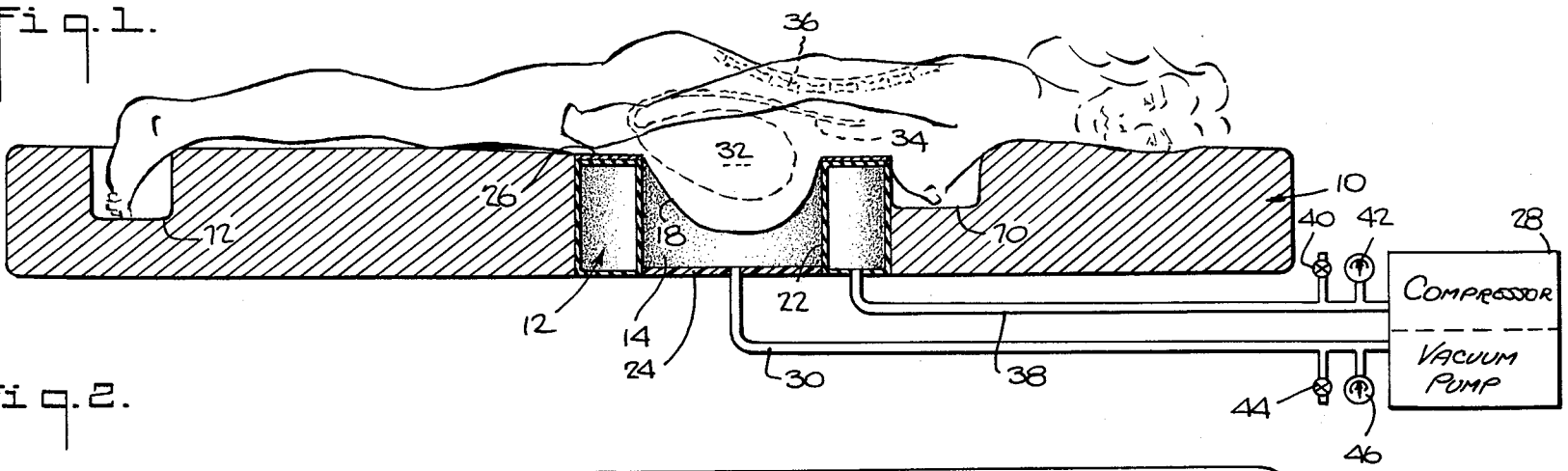
FIG. 1 is a side view, partially in cross-section of the mattress device supporting a patient, illustrative of the present invention.
Figure 2:
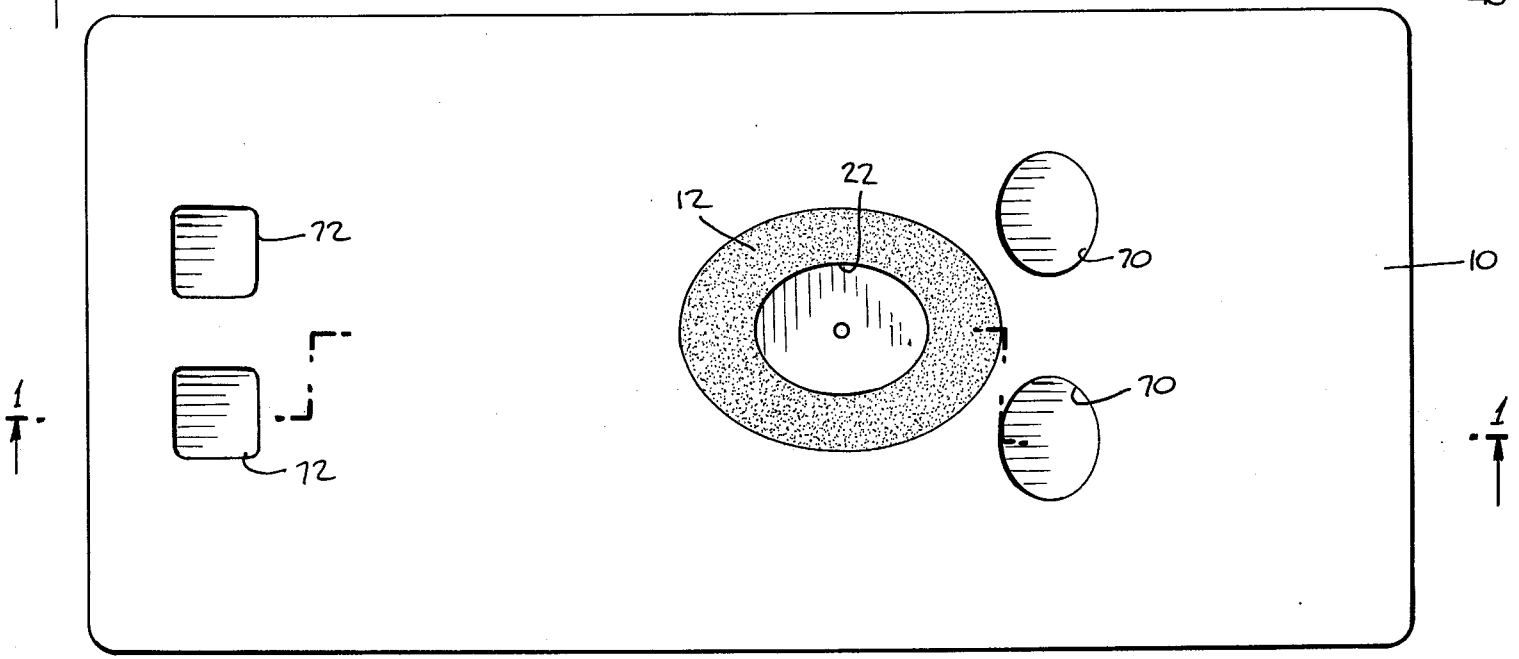
FIG. 2 is a plan view of the mattress device, also showing the sectional lines of the cross-sectional view taken in FIG. 1.

Referring to FIGS. 1 and 2 there is shown the mattress device which includes a thick mattress like member 10 made generally of the conventional foam rubber or inner spring to support a person thereon. Mattress member 10 is provided with a heavier body support means in the contral region of such member 10. The support means includes an inflated tube or ring 12 extending through the mattress with a chamber 14 formed on the central portion of the ring. The chamber 14 is open at the top for receiving the pregnant uterus of a woman lying in the prone position, with her abdominal wall 18 floating freely in the chamber. The ring 12 has a general oval configuration adapted to provide a support for the body adjacent the abdominal region, with a generally oval shaped opening at the top of the chamber 14 so as to accommodate the entire abdomen in the chamber 14. The oval shape also permits an easier sealing off of the lateral side of the abdominal wall with the ring 12. The chamber 14 formed by the ring 12 is of sufficient depth, such as 12 inches, so that the abdominal wall 18 will not make contact with the bottom wall of the chamber 14. The inflated ring 12 is filled to an air pressure which provides sufficient body support to compensate for the heavier weight around the woman's midsection. The combination of the variable air pressure of the ring 12 and the size and shape of such ring around an inner support wall 22 permit the abdominal wall 18 to float freely in the chamber 14.

The bottom of the chamber 14 is closed by a wall 24, such as a rubber or lucite plastic sheet, in air-tight relation with the side walls 22 of the ring. The top, outside surface 26 of the ring is made of or attached to a rubber-like or plastic material that can form an air-tight seal with the skin of the woman around the area adjacent the abdomen. The enclosed chamber 14 is connected in fluid communication with the vacuum pump of a compressor and vacuum unit 28. The negative pressure in the chamber 14 further relieves the pressure of the pregnant uterus and the abdominal wall on the abdominal aorta.

More specifically, the vacuum pump of the compressor and vacuum unit 28 is connected via fluid line 30 leading through bottom wall 24 into the chamber 14 for producing a near or partial vacuum therein. As mentioned above, the vacuum further relieves any pressure of the abdominal wall 18 and the pregnant uterus 32 against the abdominal aorta 34 shown in FIG. 1. The spine of the woman 20 is indicated by numeral 36. The compressor and vacuum unit 28 can have its compressor part connected via fluid line 38 to the ring 12. An adjustable valve 40 and meter 42 on line 38 permit reading of the air pressure in ring 12 as well as adjustment of the air pressure therein. Similarly, valve 44 and meter 46 are connected to the fluid line 30 for adjustment and reading the vacuum pressure on the line to the chamber 14. The air pressure in the ring 12 can be set by the valve 44 to provide the degree of support desired by the user. In this fashion, the mattress will not droop near its center due to the firmness of the ring 12.

Referring to FIGS. 3A, 3B and 3C, there are shown other embodiments of the ring 12 and the bottom chamber wall 24 shown in FIG. 1. As shown in the embodiment of FIG. 3A, the ring is comprised of two concentric, oval shaped rings 52 and 54 having separate valves 56 and 58, respectively. Each ring is about 10 to 12 inches deep and has an outer covering of plastic or rubber. This depth of the rings permit the protuberant abdomen of the pregnant woman near term to be received in the ring opening 60 with ease and comfort, with the abdominal wall floating freely without any support or pressure applied to it by the ring, the mattress or the bottom wall of the ring chamber. The plastic or rubber material on the rings 52, 54 forms an air-tight relation with the woman's body pressing down on the top surface of the rings. The inner ring 52 can be removed to accommodate a larger abdomen in the outer ring 54. The bottom wall of the opening or chamber 60 within the rings can be a firm sheet 62 of plastic which closes off the entire opening at the bottom of the rings. A valve 64 is connected to the sheet 62 for connecting the negative pressure supply of the vacuum device to the chamber.

FIGS. 3B and 3C show another embodiment of the rings 12 of FIG. 1. In FIG. 3B, ring 66 has the same outer dimension as ring 68 shown in FIG. 3C, but the inner wall-to-wall dimension 70 of ring 66 is larger than the inner wall-to-wall dimension 72 of ring 68. Both rings 66 and 68 are adapted to fit into the same size opening in the mattress, except the ring 68 is thicker and has a smaller opening for accommodating a smaller pregnant abdomen. The circular or oval top edges of the ring 66 can be attached to or form a part of a flexible plastic or rubber rim 74 indicated in dotted line, which forms an air tight seal with the skin. The rim 74 can further be provided with an adhesive material, such as a double backed adhesive tape.

Thus, the mattress device of the present invention will receive the body of the pregnant woman near term in the prone position with ease and comfort, and will enable her to remain for hours, days, and even weeks, without the inconvenience of cumbersome devices attached to her body while she remains in a standing, sitting or dorsal position. Also, the mattress device provides a negative pressure on the abdominal wall and can be easily connected to the device while the patient lies in the prone position. By this mechanism, the abdominal wall is pulled downwards causing the pregnant uterus to move even further away from the aorta. Thus, the weight of the pregnant uterus and the abdominal wall tension will not press on the abdominal aorta, the blood will flow freely to the pregnant uterus, and the fetal distress and toxemia will be relieved. It is noted that in some cases where the fetal distress and toxemia are not very severe, placing the patient in the prone position in the mattress device may be adequate treatment. Here the vacuum device can be turned off.

Some patients have breasts which cause discomfort when she is lying in the ventral position. This can be overcome by providing a pair of cavities 70, shown in FIG. 1, in the mattress member 10 at the location and of sufficient size to accommodate the breasts. In addition, a pair of cavities 72, shown in FIG. 2, can be provided in the mattress member 10 to permit greater mobility of the feet.

It is noted that various forms of rings other than the inflatable rings described above can be employed, such as an extra firm polyurethane foam ring having the required firmness for supporting the weight around the midsection of the pregnant woman.

It is noted that while the above description and drawings are directed to preferred embodiments of the present invention other changes and varations may be made from the described details which are within the spirit of this specification and the scope of the claims hereunto appended.

What is claimed is:

1. Apparatus for treating a pregnant woman, comprising:

a resilient mattress body for accommodating the woman lying in the prone position:

an inflatable ring located in an opening in the central portion of said mattress body, said inflatable ring forming a chamber which is open at the top surface of the mattress body and is of sufficient size and depth for receiving the expanded abdomen of said woman with the abdominal wall in a free floating condition in said chamber:

fluid pressure supply means for filling said inflatable ring to a pressure that provides sufficient body support for the heavier weight around the woman's midsection;

a bottom wall for enclosing the bottom of said inflatable ring such that said chamber is completely enclosed by the skin of the woman around the area adjacent the abdomen, a vacuum pump means connected to said chamber for producing a vacuum or partial vacuum therein; and fluid pressure supply adjustment means connected to said fluid pressure supply means for setting the fluid in said inflatable ring to a pressure which maintains the abdominal wall out of contact with said bottom wall of said chamber; whereby the pregnant woman can rest or sleep comfortably in the prone position on said mattress body substantially without the pressure of the pregnant uterus and the abdominal wall on the abdominal aorta.

2. Apparatus as recited in claim 1 wherein said inflatable ring has a general oval configuration.

3. Apparatus as recited in claim 1, wherein said mattress body and said inflatable ring have a depth of about 12 inches.

4. Apparatus as recited in claim 1, wherein said inflatable ring is removable from said mattress body to permit substitution of another inflatable ring having a different sized chamber opening in its center.

5. Apparatus as recited in claim 1, wherein said bottom wall is formed as a part of said inflatable ring.

6. Apparatus as recited in claim 1, wherein said bottom wall comprises a rigid plastic sheet.

7. Apparatus as recited in claim 1, wherein said inflatable ring is comprised of flexible plastic or rubber which forms an air-tight relation with the skin of said woman.

8. Apparatus as recited in claim 1, further comprising a flexible plastic or rubber rim attached to the top of said inflatable ring and extending around in a ring to provide an additional sealing area with the skin of said woman.

9. Apparatus for treating a pregnant woman while resting or sleeping, comprising: a resilient mattress body for accommodating the woman lying in the prone position:

two or more concentric, inflatable support rings located in an opening in the central portion of said mattress body, with the innermost support ring encircling a chamber which is open at the top surface of the mattress body and being of sufficient size and depth for receiving the expanded abdomen of said woman lying face downward with the abdominal wall in a free floating condition in said chamber, said support rings being individually removable from said mattress body and said support rings providing additional body support for the heavier weight around the woman's midsection:

fluid pressure supply means for filling said inflatable support rings to a pressure that provides sufficient body support for the heavier weight around the woman's midsection;

a bottom wall for enclosing the bottom of said inflatable support rings such that said chamber is completely enclosed by the skin of the woman around the area adjacent the abdomen, a vacuum pump means connected to said chamber for producing a vacuum or partial vacuum therein; and fluid pressure supply adjustment means connected to said fluid pressure supply means for setting the fluid in said inflatable rings to a pressure which maintains the abdominal wall out of contact with said bottom wall of said chamber;

whereby the pregnant woman can rest or sleep comfortably in the prone position on said mattress device substantially without the pressure of the pregnant uterus and the abdominal wall on the abdominal aorta.

10. Apparatus as recited in claim 9, wherein said inflatable rings have a general oval configuration.

11. Apparatus as recited in claim 9, wherein said support rings have a depth of about 12 inches.

12. Apparatus as recited in claim 9, further comprising an air tight flexible material lining the top edge of said inflatable support rings for forming a seal around the abdominal area of a woman lying face down on said mattress body.

* * * * *